US006079576A

United States Patent [19]

Bosler et al.

[11] Patent Number: 6,079,576

[45] **Date of Patent: *Jun. 27, 2000**

[54] CONTROL DEVICE FOR A HOIST MECHANISM OF A CRANE

[75] Inventors: Peter Bosler, Ehingen; Erwin Morath, Neuburg, both of Germany

[73] Assignee: Liebherr-Werk Ehingen GmbH, Ehingen/Donau, Germany

[ * ] Notice: This patent issued on a continued prosecution application filed under 37 CFR 1.53(d), and is subject to the twenty year patent term provisions of 35 U.S.C. 154(a)(2).

[21] Appl. No.: 08/766,407

[22] Filed: Dec. 12, 1996

[30] Foreign Application Priority Data

Dec. 13, 1995 [DE] Germany ..... 195 46 579
Feb. 7, 1996 [DE] Germany ..... 196 04 428

[51] Int. Cl.[7] ..... B66C 13/16

[52] U.S. Cl. ..... 212/278; 340/685

[58] Field of Search ..... 212/276, 277, 212/278, 281, 288, 289; 340/685

[56] References Cited

U.S. PATENT DOCUMENTS

| | | | |
|---|---|---|---|
| 3,685,290 | 8/1972 | Krusche | 91/461 |
| 3,854,593 | 12/1974 | Gross | 212/39 |
| 3,913,690 | 10/1975 | Hutchings et al. | 177/45 |
| 3,971,008 | 7/1976 | Nishizaki et al. | 212/278 |
| 4,157,736 | 6/1979 | Carbert | 173/11 |
| 4,185,280 | 1/1980 | Wilhelm | 212/278 |
| 4,187,681 | 2/1980 | Johnson | 60/905 |
| 4,222,491 | 9/1980 | Geppert | 212/289 |
| 5,160,056 | 11/1992 | Yoshimatsu et al. | 212/278 |
| 5,189,605 | 2/1993 | Zuehlke et al. | 364/140 |
| 5,297,019 | 3/1994 | Zuehlke | 364/140 |

FOREIGN PATENT DOCUMENTS

| | | | |
|---|---|---|---|
| 476460 | 3/1992 | European Pat. Off. | 212/278 |
| 1211207 | 2/1986 | U.S.S.R. | 212/288 |
| 92/08666 | 5/1992 | WIPO | 212/288 |

*Primary Examiner*—Thomas J. Brahan
*Attorney, Agent, or Firm*—Dilworth & Barrese

[57] ABSTRACT

The present invention relates to a control device for a hoist mechanism of a crane, preferably for a crane with a jib which can be varied in length and be luffed, with a hydraulic motor driving the hoist mechanism drum which motor forms a closed hydraulic circuit together with a hydraulic pump driven by a motor, preferably by a diesel engine, and with a locking brake for the hoist mechanism drum. In accordance with the invention in the high-pressure line of the hydraulic circuit a pressure gauge is positioned the signals of which are fed to a comparator unit, a unit for determining the moment of the hoist mechanism drum is provided the signals of which are fed to the comparator unit and the comparator unit together with a processing unit of the control unit adapts the pressure in the high-pressure line to the moment which must be applied by the hydraulic motor and which corresponds to the moment of the hoist mechanism drum by means of a corresponding increase or decrease of the pumping capacity in such a manner that a smooth holding, lifting or lowering of the load is possible when the locking brake is released.

17 Claims, 1 Drawing Sheet

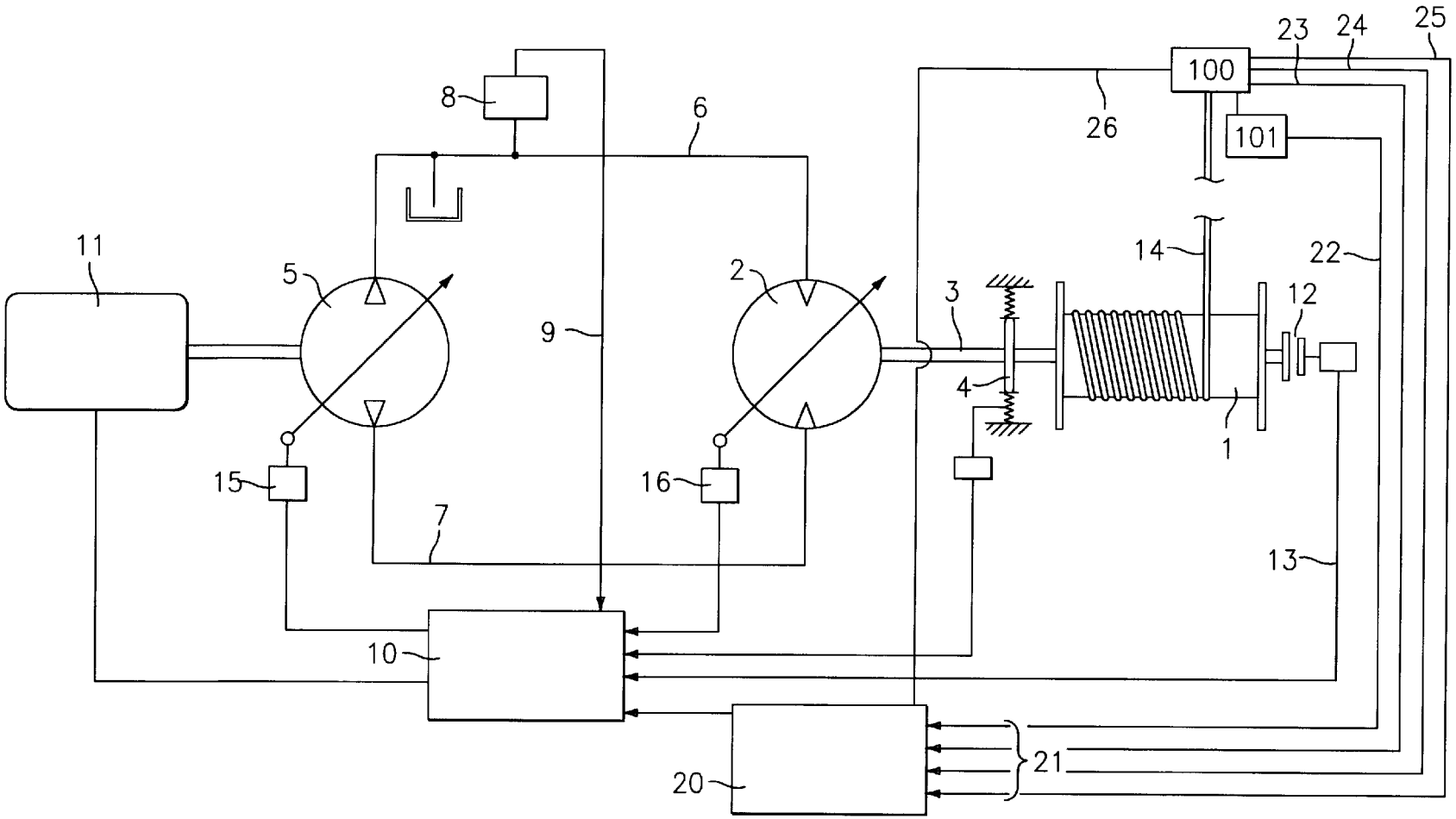
25
24
23
100
101
22
12
13
1
14
26
21
3
4
2
6
16
20
9
8
7
10
5
15
11

CONTROL DEVICE FOR A HOIST MECHANISM OF A CRANE

BACKGROUND OF THE INVENTION

The present invention relates to a control device for a hoist mechanism of a crane, preferably for a crane with a jib which can be varied in length and be luffed, with a hydraulic motor driving the hoist mechanism drum the motor forms a closed hydraulic circuit together with a hydraulic pump driven by a motor, preferably by a diesel engine, and with a locking brake for the hoist mechanism drum.

The hydraulic pump and the hydraulic motor, which are both in a closed hydraulic circuit, have a leak which can, for example, amount to two to twenty ltr./min. During the hoisting operation this leak is not particularly noticeable, as the crane operator will always move the control lever in such a way that the load is held or lifted or lowered at the desired speed, without the crane operator noticing that the inevitable leak is always being taken into account with the corresponding control. However, during crane operation it is also necessary to resume a lifting or lowering of the load after the locking brake has been released. The smooth resumption of holding, lifting or lowering of the load after the release of the locking brake would, however, only be possible if the retaining moment applied by the hydraulic motor after the release of the locking brake corresponds exactly to the moment of the hoist mechanism drum. If the locking brake is activated temporarily while the load is air-borne, due to the inevitable leakage after the release of the locking brake the pressure in the high-pressure line of the hydraulic circuit no longer corresponds exactly to the pressure by which the hydraulic motor held the air-borne load before the snapping in of the locking brake so that on the release of the locking brake jerking is inevitable due to the current pressure in the high-pressure line of the hydraulic circuit which deviates from the pressure required by the hydraulic motor.

SUMMARY OF THE INVENTION

It is the object of the present invention to provide a control device of the type described above which allows a smooth holding, lifting or lowering of an air-borne load after a release of the locking brake.

This object is solved in accordance with the invention for a control device of the generic type by the fact that in the high-pressure line of the hydraulic circuit a pressure gauge is positioned, the signals of which are fed to a comparator unit, a unit for determining the moment of the hoist mechanism drum is provided, the signals of which are fed to the comparator unit and the comparator unit together with a processing unit adapts the pressure in the high-pressure line to the moment which must be applied by the hydraulic motor and which corresponds to the moment of the hoist mechanism drum by means of a corresponding increase or decrease of the pumping capacity in such a manner that a smooth holding, lifting or lowering of the load is possible when the locking brake is released. This means that in the control device in accordance with the invention the pressure in the high-pressure line of the hydraulic circuit is constantly monitored and the signals of the pressure gauge positioned in the high-pressure line are compared with the moment of the hoist mechanism drum, with a processing unit, which for example consists of a computer, being provided which adapts the pressure in the high-pressure line which is proportionate to the motor moment to the moment of the hoist mechanism winch before the release of the locking brake so that the hoisting operation can be resumed smoothly after the release of the locking brake.

The requirement of resuming operation with the air-borne load after a release of the locking brake exists not only when the locking brake snaps in when the load is air-borne, but, for example, also when after engaging the locking brake the load deposited on the ground is picked up only by luffing the jib and the brake is released subsequently.

A preferred embodiment of the invention provides that to determine the moment of the hoist mechanism drum, the pressure of the hydraulic oil in the luffing ram, the luffing angle and the length of the jib are measured. The corresponding measured values are in general available to the central processing unit of the crane, as they have to be processed to protect against overload. From these values the pressure that has to be set in the high-pressure line of the hydraulic circuit can then also be determined with sufficient precision to permit the smooth resumption of the holding, hoisting or lowering operation of the load after the release of the locking brake.

A preferred embodiment of the invention provides that the sag is also taken into account to determine the effective length of the jib. To measure the sag of the jib, vertical angle measuring devices can be positioned in its lower and its outer areas. The sag of the jib can be determined very precisely from the measured luffing angle of the jib and the values of the vertical angle measuring devices 26 which indicate the angles of the corresponding sections of the jib to the vertical.

In accordance with a further embodiment of the invention the sag of the jib can also be determined from the measured pressure of the hydraulic liquid in the luffing ram, the measured luffing angle and the linear load of the jib. For this purpose, iteration methods may be necessary which can, however, be performed by standard computers.

To determine the moment of the hoist mechanism drum as exactly as possible, the effective drum radius must be known, which depends on the relevant winding position from which the hoist rope is currently unwinding. In accordance with a further embodiment of the invention it is therefore provided that the hoist mechanism drum is fitted with a counter or an incremental transducer to determine the current winding position of the hoist rope. The values of the incremental transducer are also constantly input into the processing unit to determine the current winch moment.

The hydraulic pump and the hydraulic motor can form a closed hydrostatic drive system. In this hydrostatic drive system the pump and the motor appropriately consist of an axial piston pump and an axial cylinder motor of oblique axle or oblique disk design.

BRIEF DESCRIPTION OF THE DRAWING

An embodiment of the present invention is shown in greater detail in the following drawing in the single figure of which a drive of the hoist mechanism drum is shown schematically.

DESCRIPTION OF THE PREFERRED EMBODIMENT

The hoist mechanism drum 1 supported by way of example on the superstructure of a mobile crane with telescoping jib 100 is driven by a controllable hydraulic motor 2, for example an axial piston motor of oblique axle or oblique disk design. The drive shaft 3 of the hydraulic motor is coupled with the shaft of the hoist mechanism drum and is provided with a brake pulley 4 by means of which the hoist mechanism drum 1 can be locked. The hydraulic motor 2 is connected with the hydraulic pump 5 which can also consist of an axial piston pump of oblique axle or oblique disk design so that the hydraulic motor 2 and the hydraulic pump 5 form a closed hydraulic circuit. In the high-pressure line 6 of the hydraulic circuit a pressure gauge 8 is positioned the signals of which are constantly fed via the signal line 9 to the electronic control unit 10 where they are monitored.

The hydraulic pump is driven by a diesel engine 11.

The shaft of the hoist mechanism drum 1 is provided with an incremental transducer 12 the signals of which are constantly fed via a signal line 13 to the central control unit 10 so that signals are emitted via a corresponding counter which report the relevant hoist rope position of the hoist mechanism drum from which the hoist mechanism rope 14 is currently unwinding or on which it is being wound up. The hydraulic pump 5 and the hydraulic motor 2 are provided with volume controller levers with which these can be regulated between the highest absorption volume and towards zero. The triggering of the volume controller levers is performed by means of the central control unit 10 via the driving units 15, 16.

The central control unit 10 is connected to the overload protection which consists of a unit 20 which receives signals from sensors via signal lines 21 which detect the load state. These are for example measuring elements which detect the pressure 22 of the hydraulic oil in the luffing ram 101, the luffing angle 23 and the length 24 of the jib and its sag 25. Not only the load state can be calculated from the signals generated by the measuring elements, they also serve to determine the moment of the hoist mechanism drum.

During crane operation after a snapping in of the locking brake 4 the latter is only released again when the pressure in the high-pressure line 6 has been adjusted via the central control unit 10 to a pressure at which the hydraulic motor 2 generates a moment which corresponds to the retaining moment of the hoist mechanism drum which retaining moment results from the current load state. This current load state is determined in the manner described and the determined value is compared in the central control unit 10 with the pressure in the high-pressure line 6 which is adapted to the motor moment before the locking brake is released which is required for a smooth resumption of the load operation.

We claim:

1. Control device for a hoist mechanism of a crane, installed with a jib arranged to be varied in length and luffed by a luffing ram, comprising:

a hydraulic motor driving a hoist mechanism drum, said hydraulic motor arranged to form a closed hydraulic circuit together with a hydraulic pump, wherein a hoist rope is wound by said hoist mechanism drum, an overload safety unit having a storage for storing measurement values of pressure of hydraulic oil in the luffing ram, angle of the luffing ram and length of the jib, and a processing unit arranged to control pumping capacity by comparing hydraulic pressure in the hydraulic circuit with a moment value of the hoist mechanism drum, a drive shaft coupled to said motor and drum, a brake pulley disposed along said motor and drum and arranged to lock said drum, high pressure lines coupling said motor and pump with a pressure gauge positioned in one of said lines and arranged to constantly feed signals to said processing unit, an engine arranged to drive said pump, and a hoist mechanism which provided with a counter or incremental transducer to determine current winding position of the hoist rope, wherein the moment value of the hoist mechanism drum is determined by the pressure of the hydraulic oil in the luffing ram, the angle of the luffing ram and the length of the jib stored in said overload safety unit.

2. A control device in accordance with claim 1, wherein sag of the jib is measured to determine its effective length.

3. A control device in accordance with claim 2, wherein to measure the sag of the jib, vertical angle measuring devices are positioned in its lower and its outer areas.

4. A control device in accordance with claim 3, wherein the sag of the jib is additionally determined from the measured pressure of the hydraulic liquid in the luffing ram, the measured luffing angle and the linear load of the jib.

5. A control device in accordance with claim 3, wherein a hoist mechanism winch is provided with a counter or incremental transducer to determine the current winding position of the hoist rope.

6. A control device in accordance with claim 3, wherein the hydraulic pump and the hydraulic motor form a closed hydrostatic drive system.

7. A control device in accordance with claim 2, wherein the sag of the jib is determined from the measured pressure of the hydraulic liquid in the luffing ram, the measured luffing angle and the linear load of the jib.

8. A control device in accordance with claim 2, wherein a hoist mechanism winch is provided with a counter or incremental transducer to determine the current winding position of the hoist rope.

9. A control device in accordance with claim 2, wherein the hydraulic pump and the hydraulic motor form a closed hydrostatic drive system.

10. A control device in accordance with claim 1, wherein sag of the jib is determined from the measured pressure of the hydraulic liquid in the luffing ram, the measured luffing angle and the linear load of the jib.

11. A control device in accordance with claim 10, wherein a hoist mechanism winch is provided with a counter or incremental transducer to determine the current winding position of the hoist rope.

12. A control device in accordance with claim 10, wherein the hydraulic pump and the hydraulic motor form a closed hydrostatic drive system.

13. A control device in accordance with claim 1, wherein A hoist mechanism winch is provided with a counter or incremental transducer to determine the current winding position of the hoist rope.

14. A control device in accordance with claim 13, wherein the hydraulic pump and the hydraulic motor form a closed hydrostatic drive system.

15. A control device in accordance with claim 1, wherein the hydraulic pump and the hydraulic motor form a closed hydrostatic drive system.

16. A control device in accordance with claim 1, wherein vertical angle measuring devices are positioned in lower and outer areas of the jib and coupled to the overload safety unit to measure sag of the jib and determine effective length of the jib, and the sag of the jib is additionally determined from the measured pressure of the hydraulic liquid in the luffing ram, the measured luffing angle and the linear load of the jib.

17. A control device in accordance with claim 1, wherein the engine is a diesel engine.

* * * * *